US009808076B1

(12) United States Patent
DeVito

(10) Patent No.: US 9,808,076 B1
(45) Date of Patent: Nov. 7, 2017

(54) ADVANCEABLE AND RETRACTABLE COSMETIC BRUSH WITH ADJUSTABLE FAN-OUT BRISTLE BUNDLING FEATURE

(71) Applicant: Ralph DeVito, Oxford, CT (US)

(72) Inventor: Ralph DeVito, Oxford, CT (US)

( * ) Notice: Subject to any disclaimer, the term of this patent is extended or adjusted under 35 U.S.C. 154(b) by 260 days.

(21) Appl. No.: 14/545,398

(22) Filed: Apr. 30, 2015

Related U.S. Application Data

(60) Provisional application No. 61/986,482, filed on Apr. 30, 2014.

(51) Int. Cl.

| | |
|---|---|
| ***A46B 7/02*** | (2006.01) |
| ***A46B 9/10*** | (2006.01) |
| ***A45D 40/26*** | (2006.01) |
| ***A46B 9/02*** | (2006.01) |

(52) U.S. Cl.
CPC ..... *A46B 7/023* (2013.01); *A45D 40/262* (2013.01); *A46B 9/021* (2013.01); *A46B 9/10* (2013.01); *A46B 2200/1046* (2013.01)

(58) Field of Classification Search
CPC ..... A46B 7/02; A46B 7/023; A46B 7/026; A46B 9/021; A46B 9/08; A46B 9/10; A46B 9/12; A46B 15/0095; A46B 17/04; A46B 2200/1046; A45D 33/34; A45D 33/36; A45D 34/042; A45D 40/262
USPC ..... 15/168, 169, 172, 184; 132/313, 317, 132/320
See application file for complete search history.

(56) References Cited

U.S. PATENT DOCUMENTS 1,005,924 A * 10/1911 Bladwin ..... B44B 11/02 15/159.1
1,048,350 A * 12/1912 Rush ..... B44B 11/02 15/184
1,090,829 A * 3/1914 Baldwin ..... B44B 11/02 15/172
1,151,364 A * 8/1915 Kaiser ..... B44B 11/02 15/184
1,563,031 A * 11/1925 Jones ..... A46B 9/08 15/169
1,749,052 A * 3/1930 Watt ..... A46B 15/00 15/184

(Continued)

FOREIGN PATENT DOCUMENTS

CH 193307 * 10/1937
CH 199951 * 9/1938
FR 1071538 * 9/1954

(Continued)

*Primary Examiner* — Mark Spisich
(74) *Attorney, Agent, or Firm* — K. Gibner Lehmann

(57) ABSTRACT

A cosmetic brush having a flare-shaped ferrule at its mouth, through which an advanceable and retractable, resilient bristle brush extends. The brush connects in the handle, with an elevator mechanism that has a cupped upper end which carries the brush, and effects the axial movement thereof. As more bristles are exposed at the ferrule's flare-shaped mouth in response to their advancing movement, the degree of flare of the brush increases. The resilience of the exposed bristles along with the flare adjustability, creates the same effect as a plurality of different sized, smaller brushes. There is thus eliminated the need for carrying multiple different sized brushes that might otherwise be required in order to produce an equivalent optimal brushing result.

10 Claims, 11 Drawing Sheets

(56) References Cited

U.S. PATENT DOCUMENTS

| | | | | | |
|---|---|---|---|---|---|
| 3,309,728 | A | * | 3/1967 | Seaver | A46B 7/023<br>15/184 |
| 5,339,483 | A | * | 8/1994 | Byun | A45D 40/10<br>132/313 |

FOREIGN PATENT DOCUMENTS

| | | | |
|---|---|---|---|
| GB | 498910 | * | 1/1939 |
| GB | 2272632 | * | 5/1994 |
| WO | 2015/065609 | * | 5/2015 |

* cited by examiner

ADVANCEABLE AND RETRACTABLE COSMETIC BRUSH WITH ADJUSTABLE FAN-OUT BRISTLE BUNDLING FEATURE

CROSS REFERENCE TO RELATED APPLICATION

The present application claims Convention priority of my Provisional Application entitled, "Adjustable cosmetic brush", U.S. Ser. No. 61/986,482 filed Apr. 30, 2014.

FIELD OF THE INVENTION

This invention relates generally to cosmetic applicator brushes, and more particularly to brushes of a type wherein the bristles of the brush are movable between advanced and retracted positions in a holder or casing, so as to enable different brushing characteristics to be realizable, as a consequence of configuring the bristles to achieve a specific, desired brushing capability or result.

BACKGROUND OF THE INVENTION

Disadvantages of the Prior Art

In the existing cosmetic field, typical applicator devices known as blush brushes have become widely accepted in dealing with efforts toward improving one's facial appearance. The issues of concern include hiding skin imperfections, and/or altering the glow or hue presented by the cheeks of the user's face. Some of the devices utilize simple push-pull mechanisms to position the brush, whereas others utilized brushes mounted on sliding carrier cups in order to effect the desired brush movements. Although several known brushes provide a flare capability to the bristles when fully advanced, none are believed to offer vernier-quality variation in both the brush size and the characteristic shape.

It is considered that there thus is a need for a cosmetic brush of the type noted, which offers improved flexibility in the brushing operation, such as variation of the brush size, alteration in the degree of flare, and/or adjustment of the stiffness characteristics of the brush bristles.

Prior to going into the summary and advantages of the invention, applicant wishes to make of record, the following references which are believed to relate to the technical field to which the present invention pertains:

U.S. Pat. Nos. 3,309,728, 3,420,134, 3,739,789, 4,248, 543, 6,226,828, 8,132,285.

U.S. Patent Application Publications Nos. 2005/0145092, 2010/0186771.

Specifically, U.S. Pat. No. 3,309,728 shows a retractable brush applicator that utilizes an elevator cup similar to those found in many twist-to-open lipsticks. A projecting pin on an elevator cup slides linearly inside an outer casing, and the cup is driven by a spiral track on a sleeve inside the outer casing. The brush shape is round thereby restricting its usefulness to situations where a single size, round brush is all that is needed.

U.S. Pat. No. 6,226,828 broadly discloses a retractable brush that is carried by a slidable, oval bushing in a casing of complementary oval cross section. The movement of the bushing and brush bristles is linear, and manually operated by sliding a projecting key in a longitudinal slot in the casing. The drawing on the face page gives the general idea. The text suggests the usage of the disclosed device as a dust-removing brush.

Several of the other listed patents show similar brush configurations. U.S. Pat. No. 3,420,134, FIG. 4, illustrates a brush carried on a push-pull bushing which is retractable into the hollow part of a handle. The function of the resulting brush is for the music field, and when used with a certain type of drum, is referred to as a snare drum brush.

In the case of Publication No. 2005/0145092, FIG. 5 shows an elongate cross slot at the upper end of a drum stick, the shape of the slot giving rise to a flared bristle configuration.

The remaining references relate to linear movements of slidably carried brushes inside handles of one type or another. One example is disclosed in U.S. Pat. No. 4,248, 543.

U.S. Pat. No. 8,132,285 utilizes a series of magnetically secured, removable and replaceable cosmetic brushes. U.S. Pat. No. 3,739,789 utilizes brushes confined by multiple nozzles having different shapes.

Patent Publication No. 2010/0186771 illustrates an application for a dusting tool, in which oval shaped bristles are formed by passing them through a shaped bushing. Flaring of the bristles occurs only as a consequence of centripetal force when an on-board motor spins the brush, as in FIG. 2 of the patent drawings.

SUMMARY OF THE INVENTION

Strictly speaking, no patent shows the exact arrangement of the invention; specifically, the keying of an elevator which carries a fine bristle brush, through a flaring nozzle, and wherein the degree of exposure of the brush can be varied to provide different degrees of flattening, for achieving different brushing effects. For example, with the brush fully advanced, a flared, wide array of brush stock is exposed, for application of product to large or expansive areas of the face. On the other hand, where it is desired to maintain a more precise, narrow application, the brush can be retraced by virtually any amount so as to provide the user with precise control over the degree of flare of the bristles. Such is useful for applying powder to the small areas of the face, particularly around the eyes, and in front of the nasal passages, as well as around the lips, and at the hairline of the user's forehead Summarizing, while the cited patents show both old and more recent cosmetic container applicators, it is believed that heretofore, no particular item stands out as having met with a large degree of success. This could perhaps be a result of unacceptable operation, promotional difficulties, financial considerations and the like. Accordingly it is considered that there still exists a need for a viable, reliable and workable adjustable, flared brush applicator, especially considering the needs that some cosmetic products demand, namely precise control of the size of the brush, depending on what part of the face is being treated.

It is considered that the present invention fulfills at least some of the following objects:

To provide a novel and improved cosmetic applicator brush which is simple in construction, and which eliminates the need for carrying multiple brushes.

To provide an improved cosmetic applicator brush as above, which in operation, features a simple twist-to-adjust manual movement that is readily comprehended by the user, without his having to read lengthy instructions on proper use, or for obtaining optimal results.

To provide an improved cosmetic applicator brush in accordance with the foregoing, which can be readily manufactured in plastic, using straightforward mold cavities.

To provide an improved cosmetic applicator brush of the type noted, which features long life, and high resistance against breakage or other malfunction.

In a preferred embodiment, the invention provides a cosmetic brush, comprising in combination an elongate handle member and a ferrule thereon, said ferrule having a flare shaped opening at its end remote from the handle member, bearing means mounting the ferrule for turning on the handle member while restraining the ferrule against axial movement thereon, said handle member having a bore and an open end, an elevator member in the handle member bore, and cooperable threads in the bore and on the elevator member, for advancing the latter through the open end of the handle member in response to relative turning of the elevator and handle members, said ferrule and elevator member having cooperable keying means, restraining relative turning movement between the elevator member and ferrule such that they rotate together, and a multi-bristle brush having a plug at one end, said brush plug being mounted to the elevator member and being movable therewith, said brush having at its other end, multiple resilient, flaring bristles whose flare is restricted by their engagement with the inner wall of the flare shaped opening of the ferrule, whereby as the brush is advanced in the ferrule, the flare of the brush increases as enabled by the shape of the ferrule's inner wall, as a consequence of the resilience of the brush bristles.

Other features and advantages will hereinafter appear.

BRIEF DESCRIPTION OF THE DRAWINGS

In the drawings, illustrating preferred embodiments of the invention.

DESCRIPTION OF THE PREFERRED EMBODIMENTS, AND BEST MODES KNOWN FOR CARRYING OUT THE INVENTION AS OF THE PRESENT FILING DATE

Essentially the invention comprises a cosmetic applicator brush having the capability of providing a bunch or bundle of fine bristle elements which, in effect, duplicate the structure and functional capabilities of a plurality of separate brushes of variable size and shape. Accordingly there is eliminated the need for a consumer to carry multiple different sized brushes in order to more uniformly and easily apply face powder or other cosmetic substance.

As is well known, cosmetic powder is widely utilized in order to hide imperfections on the skin, absorb perspiration, conceal shine, as well as imparting a smooth appearance to skin and/or change the hue or glow of light reflected from otherwise untreated skin.

Figure 1:
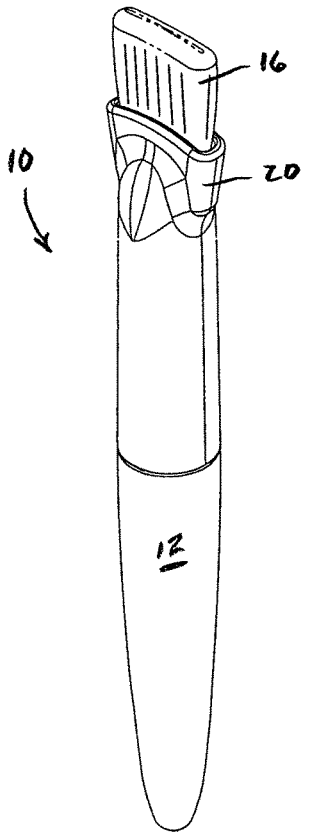
FIG. 1 is a perspective view of the cosmetic applicator brush of the present invention, and showing a bunch or bundle of fine-bristle brush elements in a substantially fully extended or advanced position. Under the present heading "BRIEF DESCRIPTION OF THE DRAWINGS" only, the terms brush and brush elements may be used generally interchangeably.
Figure 1A:
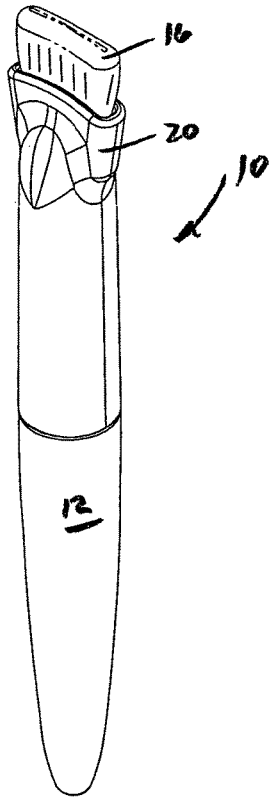
FIG. 1*a* is a view like FIG. 1, except illustrating a partial retraction of the brush.
Figure 1B:
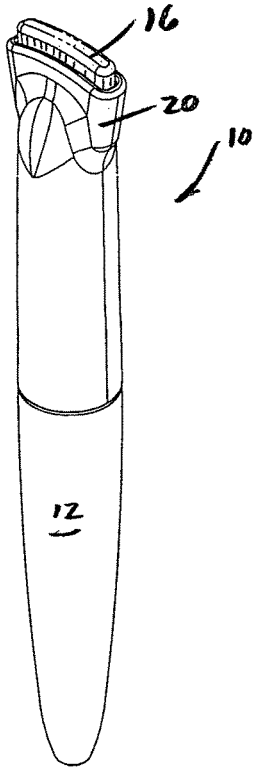
FIG. 1*b* is a view like FIGS. 1 and 1*a*, except showing a nearly full retraction of the brush.
Figure 2:
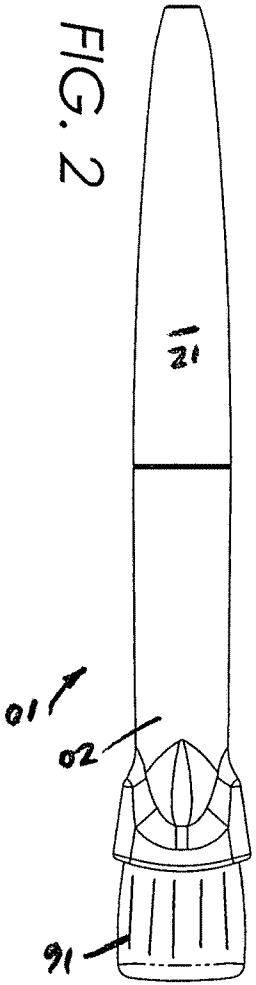
FIG. 2 is a front elevation of the cosmetic brush of FIGS. 1, 1*a* and 1*b*, with the brush elements in a substantially fully advanced position.
Figure 2A:
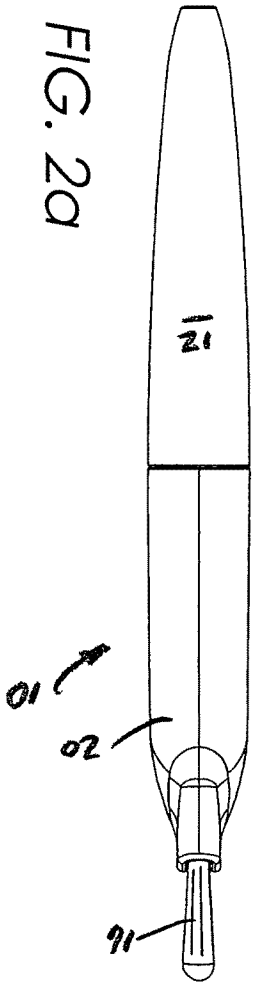
FIG. 2*a* is a right side elevation of the brush of FIGS. 1, 1*a*, 1*b*, and 2.
Figure 3:
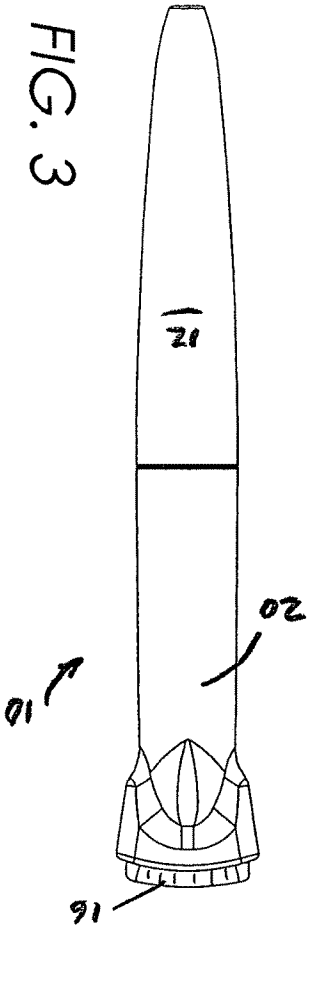
FIG. 3 is a rear elevation of the brush.
Figure 3A:
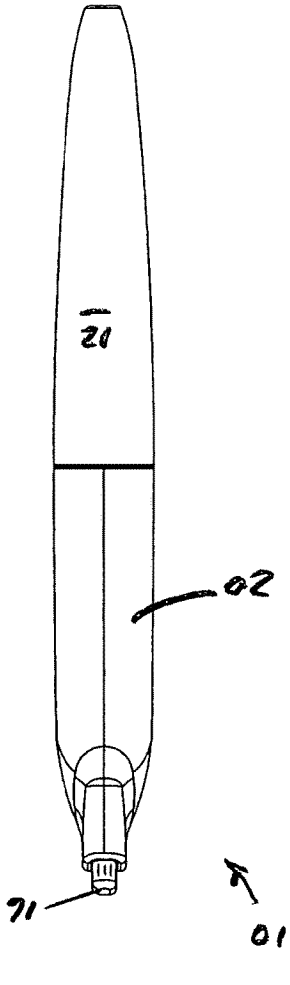
FIG. 3*a* is a left side elevation of the brush of FIG. 3.

The cosmetic brush of the present invention is shown generally in FIGS. 1, 1*a* and 1*b*, which illustrate various bristle configurations available to the consumer, as he or she uses the brush to apply cosmetic powder to his or her face.

Figure 4:
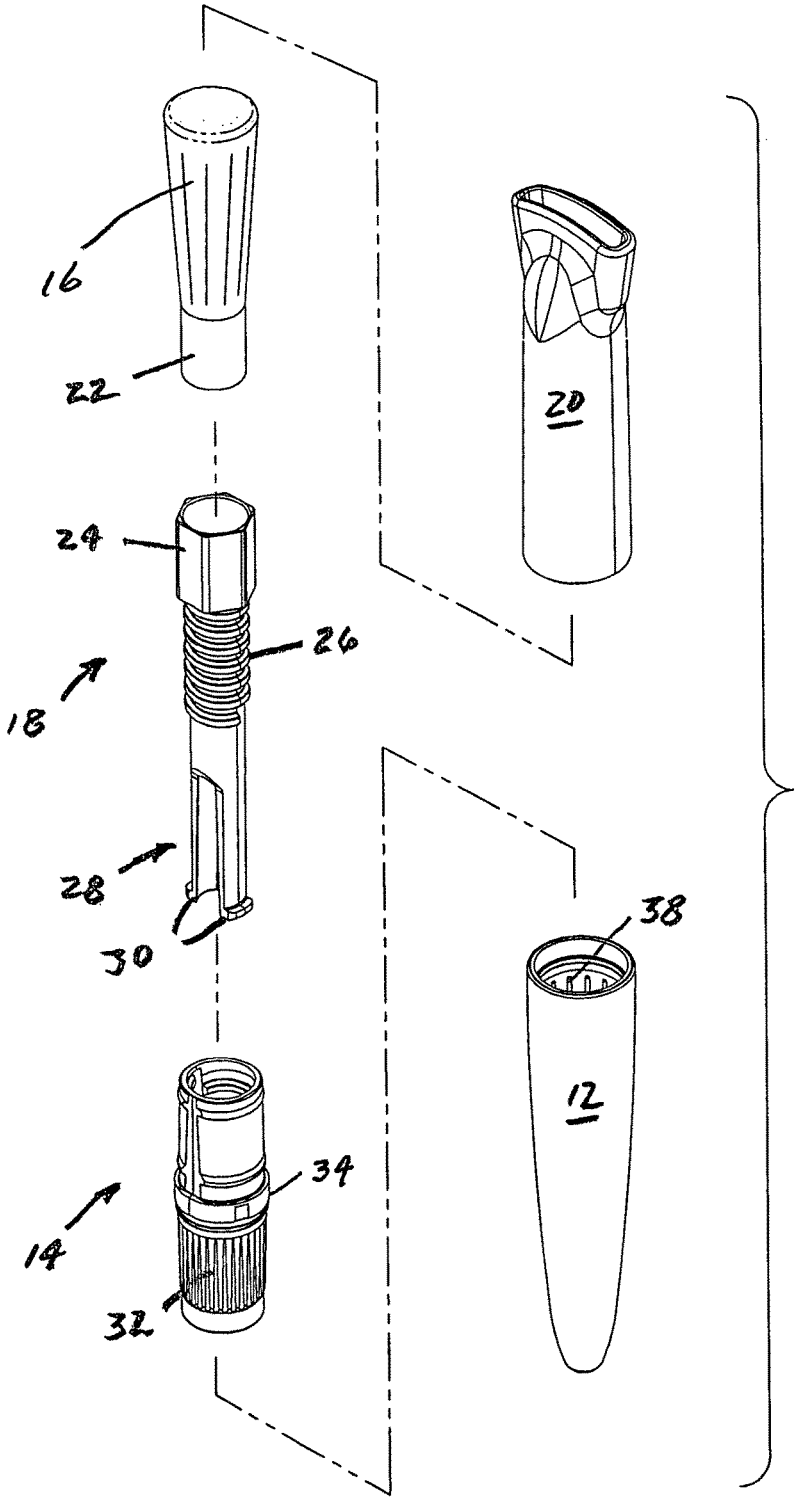
FIG. 4 is an exploded perspective view of the components of the brush of FIGS. 1, 1*a*, 1*b*, 2, 2*a*, 3, and 3*a*.

The individual parts of the assembled brush are identified in FIG. 4, in the order they would appear prior to such assembly. The structure and function of each component will be discussed in detail hereinbelow.

In FIG. 4 a total of 5 separate components can be seen, a handle and insert member therefor, indicated by the numerals 12 and 14 respectively; a fine bristle brush 16; an elevator member 18 which is involved with the advancing or retracting movement of the brush; and a ferrule 20 which has an important feature, namely shaping the bristles of the brush as they are advanced from a substantially fully retracted position as in FIG. 1*b*, to an extended, fanned out position as shown in FIG. 1.

Figure 5:
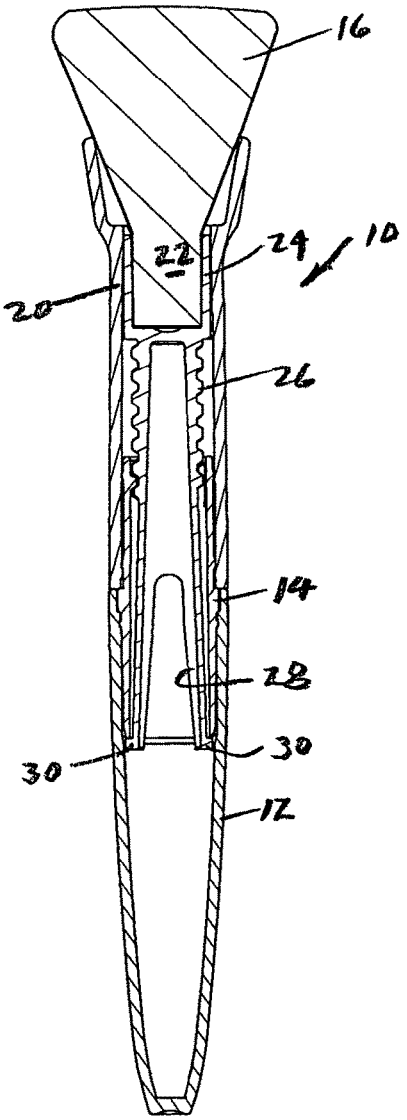
FIG. 5 is a view partly in front elevation and partly in section, of the brush of the foregoing figures, showing the bristle elements in a substantially fully advanced, flared condition.
Figure 5A:
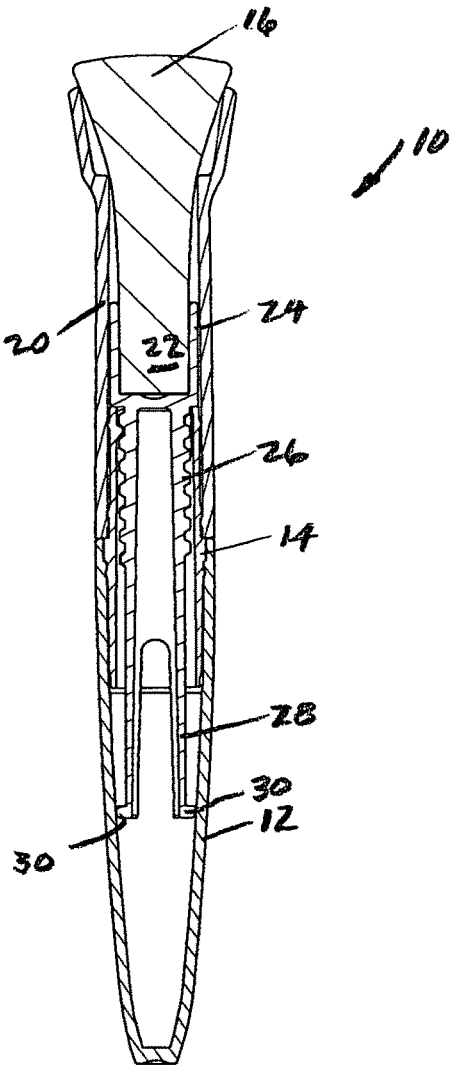
FIG. 5*a* is a view like FIG. 5, except showing the brush elements in a substantially fully retracted position.
Figure 6:
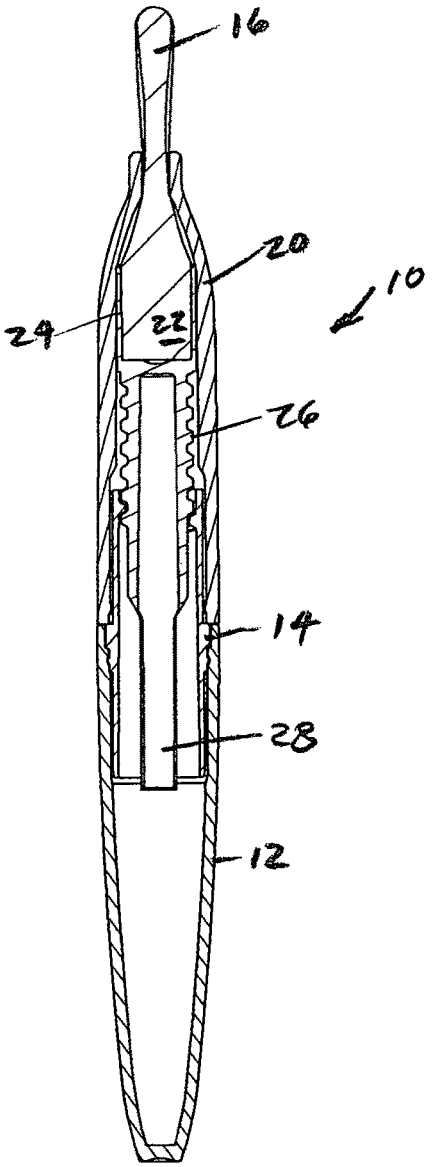
FIG. 6 is a right view, partly in section and partly in elevation of the brush of the foregoing figures, with the brush bristles substantially fully advanced.
Figure 6A:
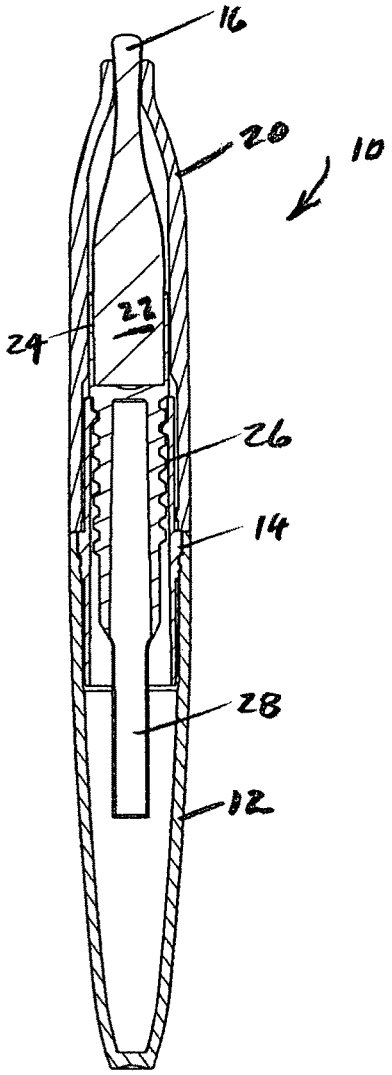
FIG. 6*a* is a view like FIG. 6, except with the brush bristles substantially fully retracted.

The brush 16 per se will be described first. Essentially it consists of a large number of fine bristle elements which, in the absence of confinement, flare out at their free ends by an extent which is similar to the showing of FIG. 5, or perhaps more depending on the resilient characteristics of the bristles. The opposite ends of the bristles are gathered together into a plug 22 which is intended to mate with an elevator cup 24 at the top of the elevator member 18, as in FIGS. 5, 5*a*, 6, and 6*a*.

Turning now to the elevator mechanism 18 per se, this is illustrated in detail in FIGS. 9, 9*a*, 9*b*, 9*c* and 9*d*, and consists of the cup 24 noted above, a central portion which also includes external threads 26, to be explained below in connection with the advancing/retracting movement of the brush, and a two-prong depending fork 28 having outturned latching lugs 30 at their extremities.

Figure 7:
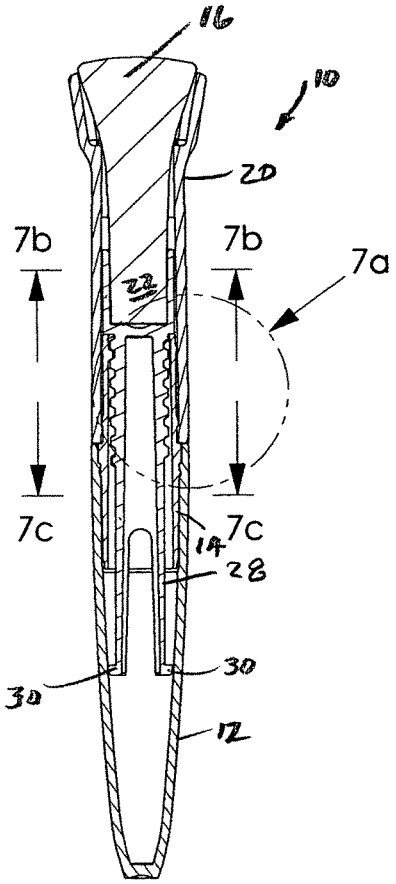
FIG. 7 is a frontal sectional view of the brush of the foregoing figures.
Figure 7A:
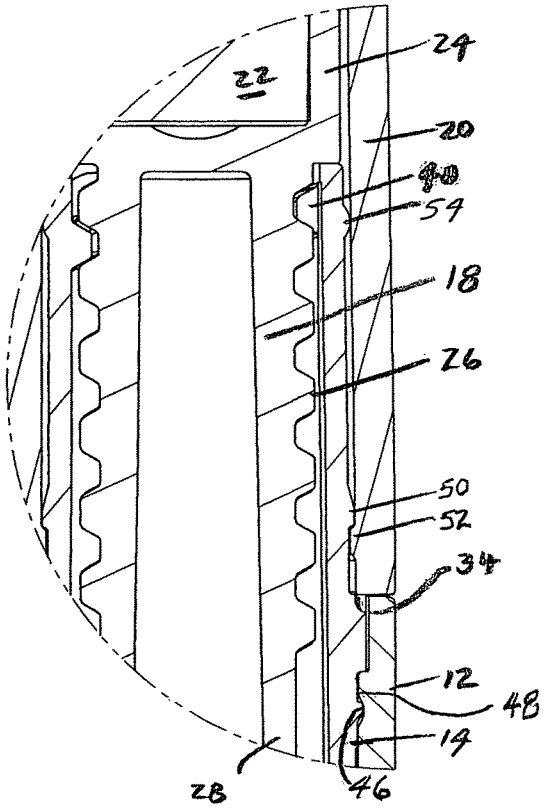
FIG. 7*a* is a detail of the area so designated in FIG. 7.

Turning next to the handle, reference is made to FIGS. 10, 10*a*, 10*b*, 10*c*, 10*d*, 10*e* and 10*f*, and FIGS. 11, 11*a*, 11*b*, 11*c* and 11*d*. There are two components that are telescopically received in one another, the outer piece or part 12 that can be grasped by the user, and an insert member 14 that telescopes into the outer piece and becomes rigid therewith. The lower portion of the insert member 14 is provided with multiple closely spaced splines 32. When the insert member 14 is pressed into the handle part, these splines 32 engage a lesser group of cooperable splines 38 on the inner surface of the outer piece 12. The engagement avoids looseness of the two components, and they in turn function as a single piece Midway of the ends of the insert member are external shoulders 34 the top of which becomes aligned with the edge of the opening of the outer piece as shown in FIGS. 7 and 7*a*. The cascaded surfaces so formed constitute abutments against which the ferrule to be described, bears in use. This bearing permits the lower edge of the ferrule 20 to rotate on the cascaded surfaces as will be noted.

Figure 9:
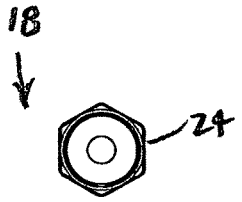
FIG. 9 is a top plan view of the elevator member utilized in the brush of the invention.
Figure 9B:
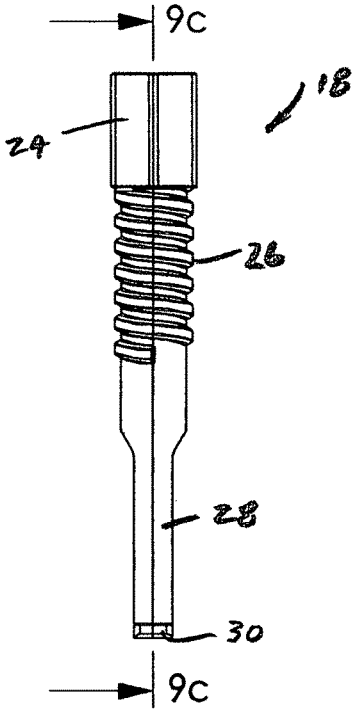
FIG. 9*b* is a side elevation of the elevator member of FIGS. 9 and 9*a*.
Figure 9C:
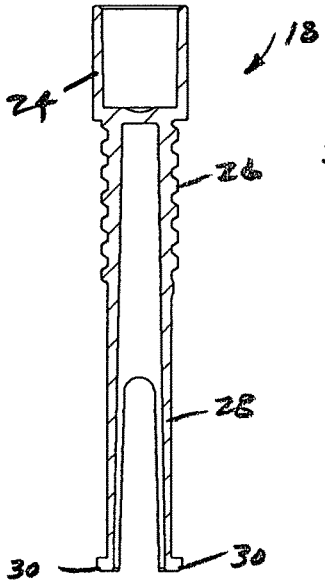
FIG. 9*c* is a section taken on the line 9*c*-9*c* of FIG. 9*b*.
Figure 9A:
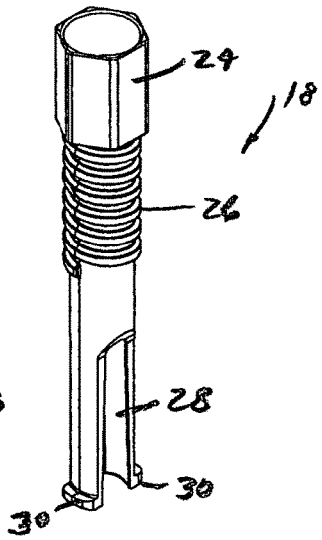
FIG. 9*a* is a perspective view of the elevator member of FIG. 9.
Figure 9D:
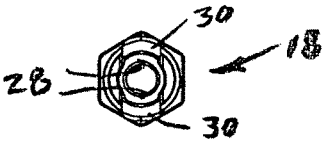
FIG. 9*d* is a bottom plan view of the ferrule of FIGS. 9, 9*a*, 9*b*, and 9*c*.

Referring again to FIGS. 4 and 7, the lower end of the elevator member has the fork configuration, with the two latching lugs 30, FIGS. 7, 9*a* and 9*c*. The purpose of these can now be understood with reference to FIG. 5. The edges constitute stop shoulders which can abut the lowermost lip of the insert member 14 when the brush is advanced, as in the figure. The engagement of the components limits the advancing movement of the elevator member 18 and hence the brush to its intended position on the handle.

Figure 7B:
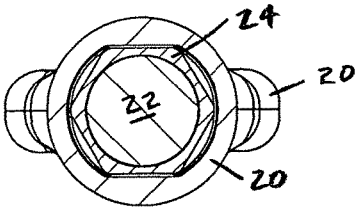
FIG. 7*b* is a top plan view of the brush of the foregoing figures.
Figure 7C:
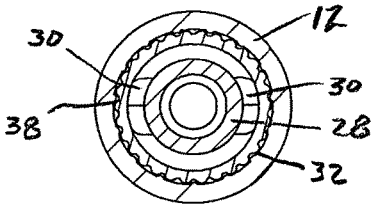
FIG. 7*c* is a bottom plan view of the brush of the foregoing figures.
Figure 8:
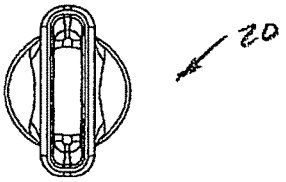
FIG. 8 is a top plan view of the ferrule utilized in the brush of the invention.
Figure 8A:
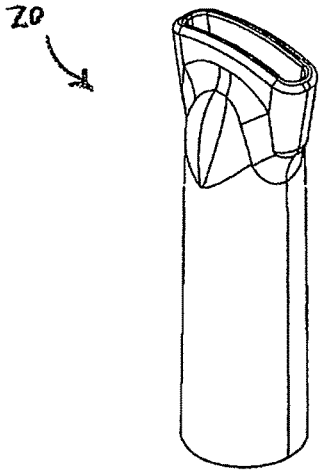
FIG. 8*a* is a perspective view of the of ferrule of FIG. 8.
Figure 8B:
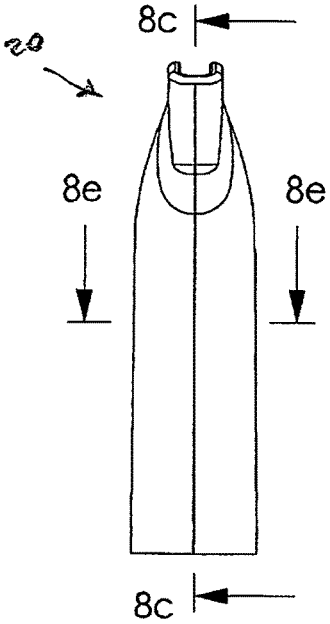
FIG. 8*b* is a right end elevation of the ferrule of FIGS. 8 and 8*a*.
Figure 8C:
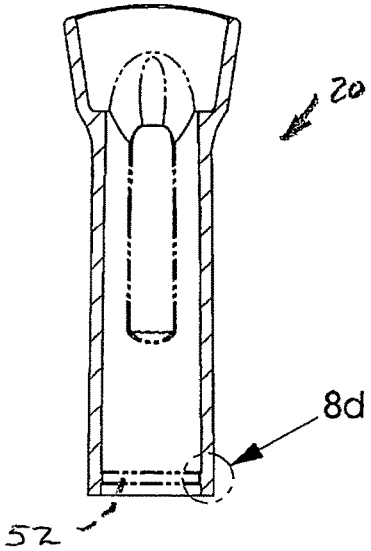
FIG. 8*c* is a section taken on the line 8*c*-8*c* of FIG. 8*b*.
Figure 8D:
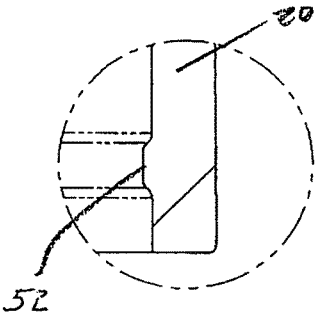
FIG. 8*d* is a detail of the area so designated in FIG. 8*c*.
Figure 8E:
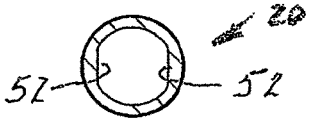
FIG. 8*e* is a bottom plan view of the ferrule of FIGS. 8, 8*a*, 8*b*, 8*c*, and 8*d*.
Figure 10:
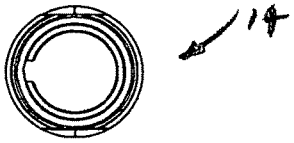
FIG. 10 is a top plan view of the insert member comprising part of the handle of the brush of the invention.
Figure 10A:
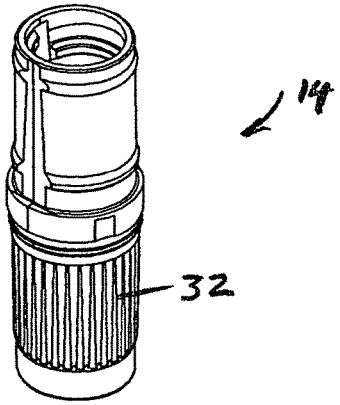
FIG. 10*a* is a perspective view of the insert member of FIG. 10.
Figure 10B:
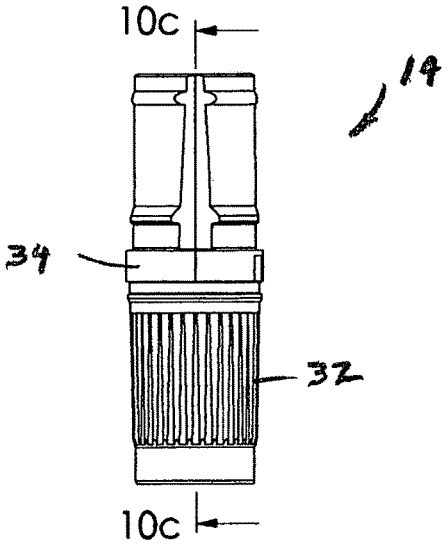
FIG. 10*b* is a front elevation of the insert member of FIGS. 10 and 10*a*.
Figure 10C:
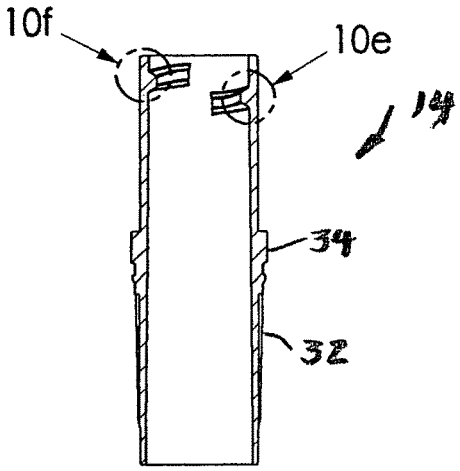
FIG. 10*c* is a frontal sectional view of the insert member of FIGS. 10, 10*a*, and 10*b*.
Figure 10D:
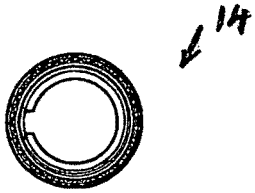
FIG. 10*d* is a bottom plan view of the insert member of FIGS. 10, 10*a*, 10*b* and 10*c*.
Figure 10F:
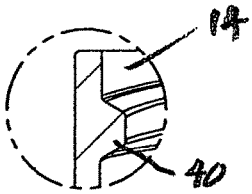
FIG. 10*f* is a detail of the area so designated in FIG. 10*c*.
Figure 10E:
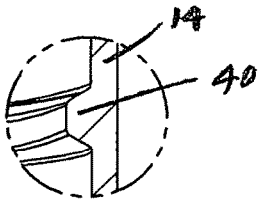
FIG. 10*e* is a detail of the area so designated in FIG. 10*c*.
Figure 11:
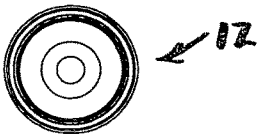
FIG. 11 is a top plan view of a handle component of the brush of the invention.
Figure 11A:
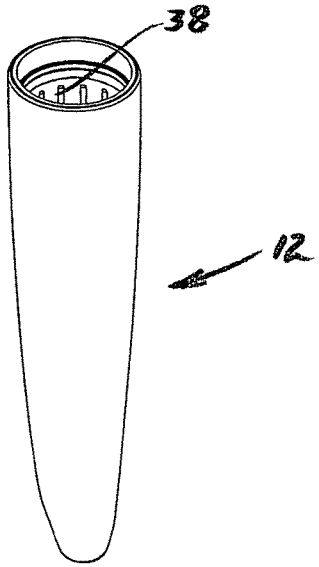
FIG. 11*a* is a perspective view of the handle component of FIG. 11.
Figure 11B:
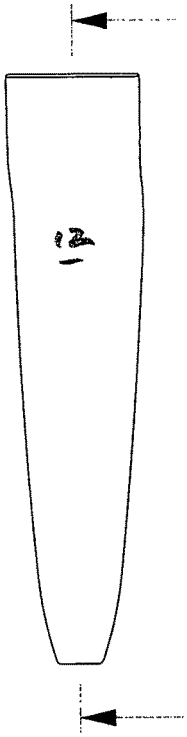
FIG. 11*b* is a right side elevation of the handle component of FIGS. 11 and 11*a*.
Figure 11C:
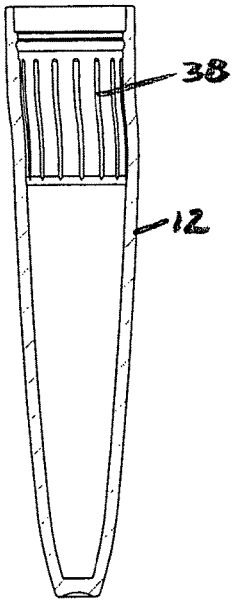
FIG. 11*c* is a section taken on the line 11*c*-11*c* of FIG. 11*b*.
Figure 11D:
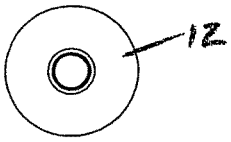
FIG. 11*d* is a bottom plan view of the handle component of FIGS. 11, 11*a*, 11*b*, and 11*c*.

Referring again to the insert member 14, FIGS. 10*e* and 10*f* illustrate a single interior helical thread segment 40 which cooperates with the multiple-helix threads 26 on the elevator member, to effect the lifting thereof. Referring to FIG. 7*b*, the elevator cup's outside surface is polygonal, in this case hexagonal. As will be explained below, by manufacturing the cup with this configuration, there is realized a keying connection between the cup 24 and the ferrule 20. The ferrule is provided with a cooperable geometric surface contour such that it is keyed with the elevator cup exterior surface, such that the two components will rotate together when the ferrule is turned with respect to the handle member. The elevator member in turn will rotate with respect to the handle member, and give rise to the advance axial movement of the brush in the ferrule.

FIG. 7*a* illustrates additional structural features which affect the positioning and operation of the handle 12 and its insert member 14. Disposed on the latter is an external bead 46 which bears against a cooperable bead 48 on the inner surface of the handle 12. The interference between these two abutments reinforces the retention of the insert member 14 inside the cover part 12. The beads by-pass one another during assembly, and thereafter remain in the positions shown in the figure.

The uppermost surface of the shoulder of the insert member is indicated at 34, and adds thickness to the existing shoulder of the cover part 12, such that the ferrule, indicated 20, has a seat against which it can turnably move. Slightly above this location are two additional shoulders, 50 and 52, one on the insert member and the other on the ferrule 20. These operate to retain the ferrule against accidental removal, while still enabling the ferrule to be manually turned. For purposes of clarification, the items in FIG. 7*a* designated 46 and 48 are rigid with one another, whereas those labelled 50 and 52 enable the ferrule movement.

Referring again to this figure, there is directly opposite the single helical thread segment 40, an abutment 54 which backs up the required engagement of the thread segment with the engagement of the elevator member threads 26. The arrangement avoids inadvertent stripping of the thread segment with the elevator member threads.

In operation, the user can advance or retract the brush by grasping the cover part 12 with the fingers of one hand, and twisting the ferrule 20. As the ferrule is twisted, and due to the keying feature noted above in connection with FIG. 7*b*, the ferrule turning is transferred directly to the elevator member. The latter, which has the brush plug, thereby undergoes movement, and depending on the direction of manual twisting, either advances or retracts the brush between the opposed positions of FIGS. 1 and 1*b*. It will be understood from this discussion, that it is the relative turning between the ferrule and handle which brings about the brush movement, and either the ferrule or the handle may be grasped and held by the user.

Figure 12:
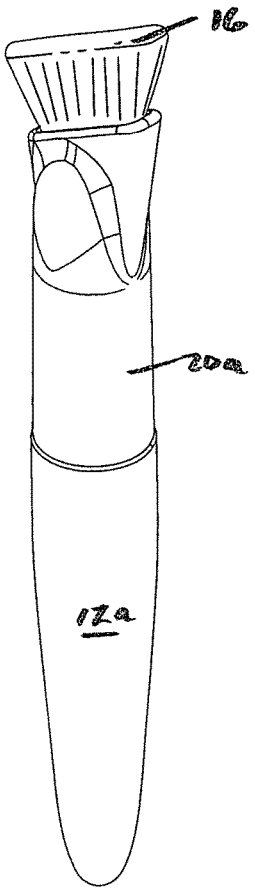
FIG. 12 is a perspective view of a modified cosmetic applicator brush, and showing a bunch or bundle of fine-bristle brush elements in a substantially fully extended or advanced position, this arrangement constituting a second embodiment of the invention.
Figure 12A:
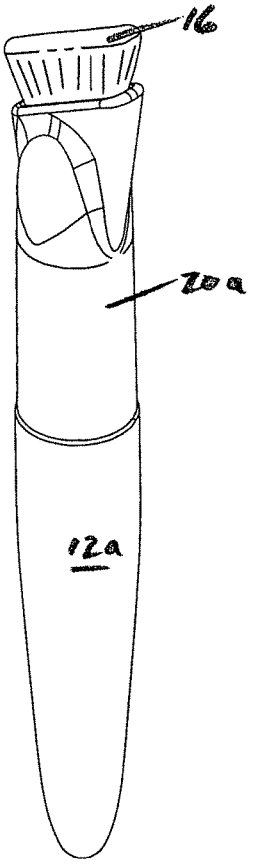
FIG. 12*a* is a view like FIG. 12, except illustrating a partial retraction of the brush or brush elements.
Figure 12B:
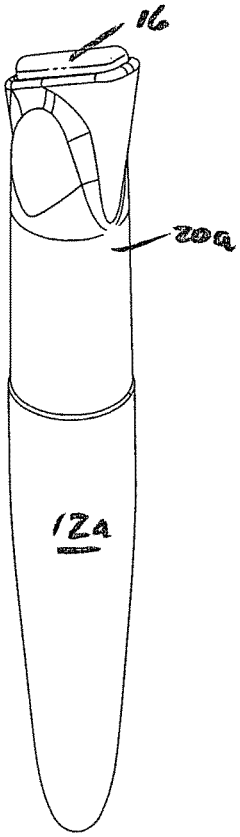
FIG. 12*b* is a view like FIGS. 12 and 12*a*, except showing a nearly full retraction of the brush or brush elements.

Another embodiment of the invention is shown in FIGS. 12, 12*a* and 12*b*. The modified applicator brush is similar in its operation to that of the already described construction. There is provided a handle part 12*a*, a ferrule 20*a* turnably carried on the handle part, and a retractable bristle brush 16. The mouth of the ferrule 20*a* is disposed at a small angle with the axis of the handle part, and the upper end of the bristle brush is similarly skewed. The arrangement may be more convenient for some users in that certain difficult areas of the face may be more easily accessed, and with less strain on the hand of the user.

From the above it can be seen that I have provided novel and improved applicator brushes which are straightforward in their construction, and which substantially eliminate the need for a consumer to carry a larger number of separate smaller brushes, while still retaining the flexibility of the smaller units.

The applicator brushes are thus seen to represent a distinct advance and improvement in the cosmetic field.

Each and every one of the appended claims represents an aspect of the invention which is separate and distinct from all others, and accordingly it is intended that each claim be treated as such when examined in the light of the prior art devices in any determination of novelty or validity.

Variations and modifications are possible without departing from the spirit of the invention.

LISTING OF REFERENCE NUMERALS

10 Cosmetic brush assembled
12 Handle part
14 Insert member fitted into handle part
16 Bristle brush
18 Elevator member
20 Ferrule
22 Plug of gathered bristles
24 Elevator cup
26 Threads on elevator member
28 Depending fork on elevator cup
30 Latching lug
32 Splines on insert member
34 Shoulder on insert member exterior
38 Splines on inner surface of handle part
40 Single helical thread on insert member
46 Bead
48 Bead
50 Shoulder
52 Shoulder
54 Abutment The embodiments of the invention in which an exclusive property or privilege is claimed are defined as follows:

1. A cosmetic brush, comprising in combination:
a) an elongate handle member and a ferrule thereon, said ferrule having a flare shaped opening at its end remote from the handle member,
b) bearing means mounting the ferrule for turning on the handle member while restraining the ferrule against axial movement thereon,
c) said handle member having a bore and an open end,
d) an elevator member in the handle member bore, and cooperable threads in the bore and on the elevator member, for advancing the latter through the open end of the handle member in response to relative turning of the elevator and handle members,
e) said ferrule and elevator member having cooperable keying means, restraining relative turning movement between the elevator member and ferrule such that they rotate together, and
f) a multi-bristle brush having a plug at one end, said brush plug being mounted to the elevator member and being movable therewith, said brush having at its other end, multiple resilient, flaring bristles whose flare is restricted by their engagement with the inner wall of the flare shaped opening of the ferrule, whereby as the brush is advanced in the ferrule, the flare of the brush increases as enabled by the shape of the ferrule's inner wall, as a consequence of the resilience of the brush bristles.

2. The invention as set forth in claim 1, wherein:
a) the ferrule is keyed to the elevator member, and both the ferrule and elevator member as a unit, are turnable with respect to said elongate handle member, to effect said advancing movement of the elevator member and multi-bristle brush.

3. The invention as set forth in claim 1, wherein:
a) the elevator member includes an elevator cup having an exterior polygonal surface, with multiple flats,
b) the ferrule has at least two flat surfaces which bear against the elevator cup flats, so as to effect keying of the elevator member and ferrule.

4. The invention as set forth in claim 1, and further including:
a) an insert member disposed in the handle member, and wherein:
b) the bore of the handle member has a series of splines projecting from the surface thereof, and
c) said insert member has a series of splines projecting from the surface thereof, said handle member splines inter-locking with said insert member splines so as to lock the two members together in fixed relation.

5. The invention as set forth in claim 4, wherein:
a) said elevator member comprises a depending fork ex-tending into the interior of the handle member, said fork having a pair of tines with latching lugs at their ends, said latching lugs being engageable with a shoulder on the insert member so as to limit the outward movement of the elevator member to a predetermined extent.

6. The invention as set forth in claim 1, and further including:
a) an insert member disposed in said handle member, and wherein said insert member and ferrule having interfering lugs which effects retention of the ferrule, and prevents the latter from accidental, undesired removal from the handle member.

7. The invention as set forth in claim 6, wherein:
a) said cooperable threads comprise a multi-turn helical thread on the elevator member, and a helical thread segment of 360 degrees or less, in engagement with the multi-turn helical thread on the elevator member.

8. The invention as set forth in claim 7, and further including:
a) a shoulder on the insert member, disposed on the wall thereof and located opposite to the location of said thread segment, so as to strengthen said wall against inadvertent de-formation when the thread segment is operative.

9. The invention as set forth in claim 1, wherein:
a) the elevator member has an elevator cup into which said brush plug is pressed, and held captive.

10. The invention as set forth in claim 1, wherein:
a) the elevator member comprises a cup which holds the brush, and wherein:
b) said elevator member further comprises a depending fork,
c) the threads on the elevator member are integral with the cup and integral with the depending fork.

* * * * *